US005182713A

United States Patent [19]

Kitoh

[11] Patent Number: 5,182,713

[45] Date of Patent: Jan. 26, 1993

[54] TURNING BRAKE CONTROLLING SYSTEM FOR USE IN POWER SHOVEL

[75] Inventor: Hidenori Kitoh, Hiratsuka, Japan

[73] Assignee: Kabushiki Kaisha Komatsu Seisakusho, Tokyo, Japan

[21] Appl. No.: 832,643

[22] PCT Filed: Mar. 22, 1989

[86] PCT No.: PCT/JP89/00304

§ 371 Date: Jan. 11, 1990

§ 102(e) Date: Jan. 11, 1990

[87] PCT Pub. No.: WO89/09310

PCT Pub. Date: Oct. 5, 1989

Related U.S. Application Data

[63] Continuation of Ser. No. 696,276, May 2, 1991, abandoned, which is a continuation of Ser. No. 445,631, Jan. 11, 1990, abandoned.

[30] Foreign Application Priority Data

Mar. 22, 1988 [JP] Japan ..... 63-65881
May 19, 1988 [JP] Japan ..... 63-120501

[51] Int. Cl.[5] ..... G06F 15/20

[52] U.S. Cl. ..... 364/424.01; 364/184; 37/DIG. 1

[58] Field of Search ..... 364/431.11, 184, 186, 364/187, 450, 451, 424.01, 424.03, 424.07; 414/694, 690, 699; 37/DIG. 1; 303/92, 9.63, 94, 95

[56] References Cited

U.S. PATENT DOCUMENTS 4,377,043 3/1983 Inui et al. ..... 37/DIG. 1
4,739,469 4/1988 Oshiage et al. ..... 364/187
4,748,566 5/1988 Sasaki et al. ..... 364/431.11
4,889,466 12/1989 Jindai et al. ..... 414/699

FOREIGN PATENT DOCUMENTS 62-13619 1/1987 Japan .
63-55223 3/1988 Japan .
63-312432 12/1988 Japan .

*Primary Examiner*—Thomas G. Black
*Attorney, Agent, or Firm*—Armstrong, Westerman, Hattori, McLeland & Naughton

[57] ABSTRACT

A turning brake controlling system for use in power shovel arranged such that even when a microprocessor for controlling the operation of the turning brake actuator means malfunctions the turning brake can be applied without fail by shifting a turning lever to its neutral position, and the upper turning body can be stopped at a predetermined position without being subjected to the influence of external forces such as gravity, etc. when it is turned slowly on a slope. The turning brake controlling system has a turning lever signal transmitter (1) adapted to output a turning lever signal "a" when the turning lever is shifted from its turning position to its neutral position, and a turning brake actuating signal generator (2) adapted to receive the turning lever signal and output a turning brake actuating signal (h) to a turning brake actuator means (3).

4 Claims, 5 Drawing Sheets

TURNING BRAKE CONTROLLING SYSTEM FOR USE IN POWER SHOVEL

This application is a continuation of application Ser. No. 696,276 filed May 2, 1991, which in turn is a continuation of application Ser. No. 445,631, filed Jan. 11, 1990, now abandoned.

TECHNICAL FIELD OF THE INVENTION

This invention relates to a turning brake controlling system for use in a power shovel having an excavating implement mounted on the vehicle body thereof so that it can be turned.

BACKGROUND TECHNIQUE OF THE INVENTION

A turning brake controlling system for applying braking force on the upper turning body of a power shovel is arranged to be actuated automatically to apply braking force on the upper turning body when the turning brake is actuated intentionally by the operator of the power shovel or when the turning lever for turning the upper turning body is shifted to its neutral position in order to stop the turning of the upper turning body. The turning brake means is usually adapted to be actuated several seconds after the turning lever is shifted from its "turning" position to its "neutral" position, thereby preventing sudden stoppage of the upper turning body.

Since the delay time for the turning brake; that is; the time which passes from the shifting of the turning lever from its "turning" position to its "neutral" position until the actuation of the turning brake controlling system is predetermined, in the case of turning operations of the shovel on a slope, if positioning of the upper turning body in the turning direction is made by turning it slowly, then the upper turning body is turned during the delay time for the turning brake under the influence of gravity and leakage of fluid from the hydraulic motor so that it is difficult to stop it towards a target.

Further, in case the above-mentioned conventional turning brake controlling system is controlled by means of a microprocessor, if the microprocessor fails to fulfill arithmetic function as programmed for some cause such as noise or static electricity, etc., then the binary ON-OFF control signal becomes unstable, or only either ON output or OFF output can be developed. As a result, the controlling function of the turning brake controlling system is completely lost thus creating a dangerous condition, so that the operator cannot help stopping the operation.

SUMMARY OF THE INVENTION

The present invention has been made in view of the above-mentioned circumstances, and has for its first object to provide a turning brake controlling system for use in a power shovel arranged such that even when a microprocessor for controlling the operation of a turning brake actuator means malfunctions the turning brake can be actuated several seconds after the turning lever is shifted form its "turning" position to its "neutral" position.

Further, the second object of the present invention is to provide a turning brake controlling system for use in a power shovel arranged such that when the turning speed of the upper turning body becomes lower than a predetermined value the turning brake can be actuated even if it occurs during the delay time for the turning brake, thereby eliminating free movement or turning of the upper turning body by the force of gravity, etc. during the delay time for the turning brake, and accurate positioning of the upper turning body can be made in turning it slowly when the power shovel is on a slope.

Further, the third object of the present invention is to provide a turning brake controlling system for use in a power shovel arranged such that the delay time for the turning brake may be varied with the turning speed of the upper turning body when the turning lever is shifted from its turning position to its neutral position so that in case the turning speed is slow the delay time for the turning brake is reduced, and in particular in case of slow turning operations on a slope, when the turning lever is shifted from its turning position to its neutral position, the upper turning body is prevented from turning freely under the influence of external forces such as the force of gravity, etc..

To achieve the above-mentioned objects, according to the first aspect of the present invention, there is provided a turning brake controlling system for use in an upper turning body of a power shovel arranged to receive, as an input thereof, a turning lever signal outputted by a turning lever signal transmitter when the turning lever is shifted from its turning position to its neutral position and output a turning brake actuating signal to a turning brake actuator means, comprising: a microprocessor for outputting a turning brake actuating signal to the turning brake actuator means; a microprocessor monitoring means for monitoring the operation of the microprocessor; a hardware circuit connected in parallel with the microprocessor and which fulfills a function corresponding to the arithmetic function of the microprocessor; and a switching circuit for switching output of the microprocessor over to output of said hardware circuit in accordance with the actuation of said microprocessor monitoring means.

To achieve the above-mentioned objects, according to the second aspect of the present invention, there is provided a turning brake controlling system for use in a power shovel, characterized in that the microprocessor and/or hardware circuit as described in the first aspect includes a turning speed detector means adapted to detect the turning speed of the upper turning body when the turning lever is shifted from its turning position to its neutral position and the subsequent speeds thereof and output a turning speed signal corresponding to the thus detected turning speed; and a turning brake signal generator means adapted to receive, as inputs thereof, the turning speed signal outputted by the turning speed detector means and the turning lever signal outputted by the turning lever signal transmitter and output a turning brake signal to the turning brake actuator means.

To achieve the above-mentioned objects, according to the third aspect of the present invention, there is provided a turning brake controlling system for use in a power shovel, characterized in that the turning brake signal generator means as described in the second aspect is arranged to output a turning brake signal when the turning speed signal becomes less than a preset value.

To achieve the above-mentioned objects, according to the fourth aspect of the present invention, there is provided a turning brake controlling system for use in a power shovel, characterized in that the turning brake signal generator means as described in the second aspect is arranged to output a turning brake signal in a delay time which is preset in accordance with the value of the turning speed signal.

The above-mentioned and other objects, aspects and advantages of the present invention will become apparent to those skilled in the art by making reference to the following description and the accompanying drawings in which preferred embodiments incorporating the principles of the present invention are shown by way of examples only.

DETAILED DESCRIPTION OF THE DRAWINGS

DETAILED DESCRIPTION OF PREFERRED EMBODIMENTS

The present invention will now be described below by way of the first, second and third embodiments thereof with reference to the accompanying drawings.

In the first place, the first embodiment of the present invention will be described with reference to FIG. 1.

Figure 1:
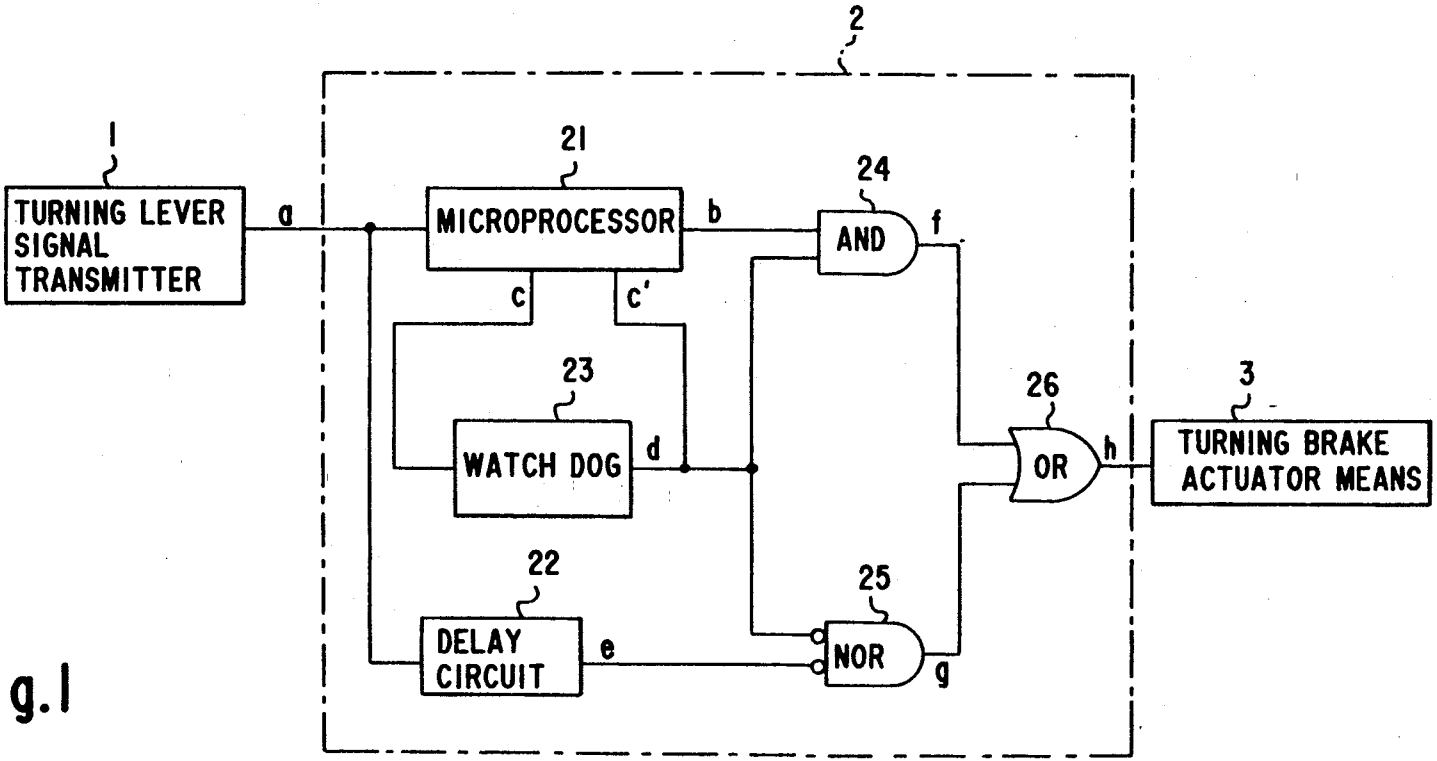
FIG. 1 is a block diagram schematically showing the principal parts of a first embodiment of the present invention.

In FIG. 1, reference numeral 1 denotes a turning lever signal transmitter adapted to output or transmit a turning lever signal a when a turning lever, not shown, for operating the turning of an upper turning body (not shown) of a power shovel is shifted to its neutral position.

Reference numeral 2 denotes a power shovel turning brake controlling system adapted to receive a turning lever signal a and output or transmit a turning brake actuating signal to a turning brake actuator means 3. This turning brake controlling system 2 includes a microprocessor 21 adapted to receive, as an input thereof, a turning lever signal a, and a delay circuit 22 serving as a hardware circuit. This delay circuit 22 fulfills a function which corresponds to the arithmetic function of the microprocessor 21.

Reference numeral 23 denotes a watchdog which serves as a monitoring means for the microprocessor 21 and which receives, as an input thereof, a signal c outputted by the microprocessor 21 which is either a normal signal "1" or an abnormal signal "0". This microprocessor 21 is adapted to be unreset when the signal d outputted by the watchdog 23 is a normal signal "1", and reset when the signal is an abnormal signal "0". Further, the watchdog 23 is adapted to output a normal signal "1" when the signal c is a normal signal "1", and output an abnormal signal "0" when the signal c is an abnormal signal.

Reference numeral 24 denotes an AND circuit which receives, as an input thereof, a signal b outputted by the microprocessor 21 and a signal d outputted by the watchdog 23 and which is adapted to output a signal f that becomes a normal signal "1" only when the signals b and d are normal signals "1".

Reference numeral 25 denotes a NOR circuit which receives at its input side the output signal d from the watchdog 23 and an output signal e from the delay circuit 22 and which is adapted to output a signal g.

Reference numeral 26 denotes an OR circuit which receives, at its input side, output signals f and g from AND circuit 24 and NOR circuit 25, respectively, and which is adapted to transmit a signal h to the turning brake actuator means 3.

The operation of the first embodiment having the above-mentioned configuration will be described below.

In case the microprocessor 21 is working normally, if a turning lever signal a which is generated by the turning lever signal transmitter 1 and which is a neutral position signal "1" is inputted to the input side of the microprocessor 21, the microprocessor 21 will output a signal c, which is a normal signal "1", to the watchdog 23. As a result, the watchdog 23 will also output a signal d which is a normal signal "1", so that the microprocessor 21 is not reset. Thus, the microprocessor 21 will output a signal b, which is representative of the result of operation by the microprocessor, to one input side of AND circuit 24. At that time, AND circuit 24 will receive at its another input side the output signal d (which is a normal signal "1") from the watchdog 23, so that AND circuit 24 will output a signal f which is representative of the result of operation by the microprocessor 21.

Whilst, NOR circuit 25 will output a signal g which is an abnormal signal "0", since the output signal d from the watchdog 23 is a normal signal "1". As a result, OR circuit 26 will receive an output signal f from the AND circuit 24, i.e. the result of operation by the microprocessor 21 and output a signal h so that the turning brake actuator means 3 will be controlled in accordance with the result of operation by the microprocessor 21.

Next, the operation of the controlling system when the microprocessor 21 mulfunctions will be described.

Since the output signal c from the micro-processor 21 is not a normal signal "1" when the microprocessor 21 malfunctions, the watchdog 23 will output a signal d which is an abnormal signal "0". As a result, the microprocessor 21 will be reset by the abnormal signal d. At that time, since an abnormal signal "0" form the watchdog 23 is input to one input side of AND circuit 24, the latter will output a signal f which is an abnormal signal "0". Further, a turning lever signal "a" is then outputted by the turning lever signal transmitter 1. The turning lever signal a is delayed several seconds by the delay circuit 22 and is outputted by the latter as a signal e. At that time, since the signal d, which is an abnormal signal "0", from the watchdog 23 is input to an input side of NOR circuit 25, the latter will output or transmit a signal g (which is an inverted signal) corresponds to the output signal e from the delay circuit 22.

At that time, since OR circuit 26 will receive, at its one input side, a signal f, which is an abnormal signal "0", from the AND circuit 24, the OR circuit 26 will invert the signal from the turning lever signal transmitter 1 and output a signal h the transmission of which is delayed by several seconds by the delay circuit 22 Thus, the turning brake actuator means 3 will be controlled in accordance with the inverted signal h.

Subsequently, the second embodiment of the present invention will be described with reference to FIGS. 2 and 4.

Figure 2:
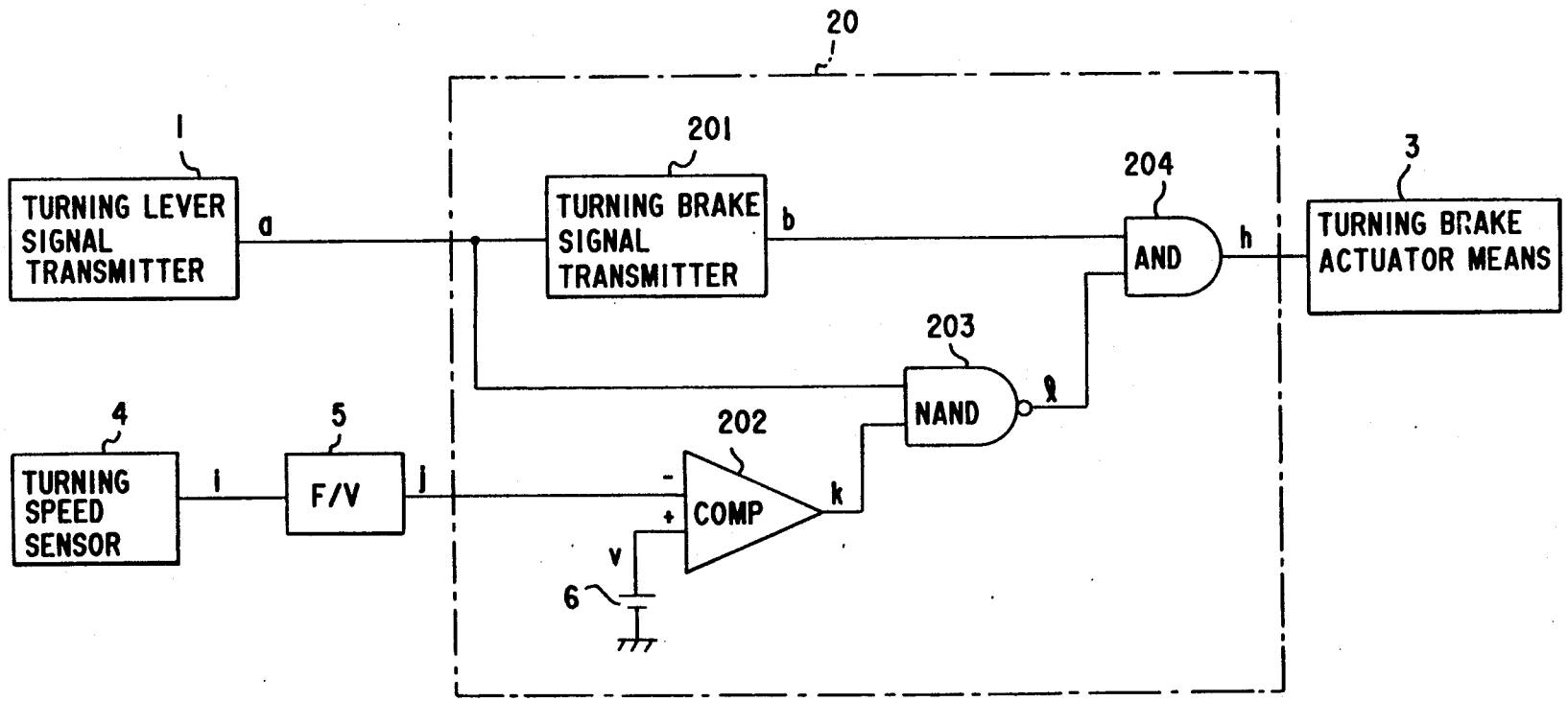
FIG. 2 is a block diagram schematically showing the principal parts of a second embodiment of the present invention.

In FIG. 2, the components indicated by the same reference numerals and reference symbols as those used in FIG. 1 have the same functions, and therefore the description thereof is omitted herein to avoid the duplication of explanation.

In FIG. 2, reference numeral 20 denotes a turning brake controlling system arranged in the same configuration as those of this sort of conventional controlling systems and adapted, when a turning lever (not shown) is shifted from it turning position to its neutral position, to receive a turning lever signal a transmitted by the turning lever signal transmitter 1 and output or transmit a turning brake actuating signal to the turning brake actuator means 3.

Reference numeral 5 denotes a F/V converter adapted to receive, as an input thereof, a pulse signal i from a turning speed sensor 4 which picks up the rotation of a turning motor (not shown) for turning the upper turning body of a power shovel, not shown, and convert the pulse signal i into a voltage corresponding to the frequency thereof so as to output a variable voltage signal j. Reference numeral 6 denotes a reference voltage source or generator means adapted to generate a reference voltage signal v for defining the minimum turning speed of the upper turning body.

The turning brake controlling system 20 in the second embodiment comprises a turning brake signal transmitter 201 adapted to receive a turning lever signal a which is outputted by the turning lever signal transmitter 1 and output a turning brake signal b a predetermined time after the turning lever is shifted from its turning position to its neutral position; a comparator 202 adapted to receive, as inputs thereof, the variable voltage signal i from the above-mentioned F/V converter 5 and the reference signal voltage signal v from the reference voltage generator means 6, compare these signals and output a comparison signal k, a NAND circuit 203 adapted to receive, as inputs thereof; the comparison signal k and the turning lever signal a; and an AND circuit 204 adapted to receive, as inputs thereof, a NAND signal l from NAND circuit 203 and the turning brake signal b from the aforementioned turning brake signal transmitter 201, and output an AND signal h (turning brake actuating signal) to the turning brake actuator means 3 in accordance with the signals l and b.

Next, the operation of the second embodiment having the above-mentioned configuration will be described.

The turning lever signal a transmitted by the turning lever signal transmitter 1 is a binary signal which is either "0" or "1". Since the signal a is "0" when the upper turning body of a power shovel, not shown, is turning, NAND circuit 203 will output a normal signal "1" as a NAND signal l, regardless of the nature of the comparison signal k from the comparator 202. Whilst, at that time, since the turning lever signal a is an abnormal signal "0", the turning brake signal b transmitted by the turning brake signal transmitter 201 will become a normal signal "1" which is a brake release signal. Thus, the AND circuit 204 will receive the turning brake signal b and the NAND signal l, both of which are "1" and output a turning brake actuating signal h, which is a turning brake release signal "1", to the turning brake actuator means 3.

Figures 4A, 4B, 4C, 4D, 4E, 4F, 4G:
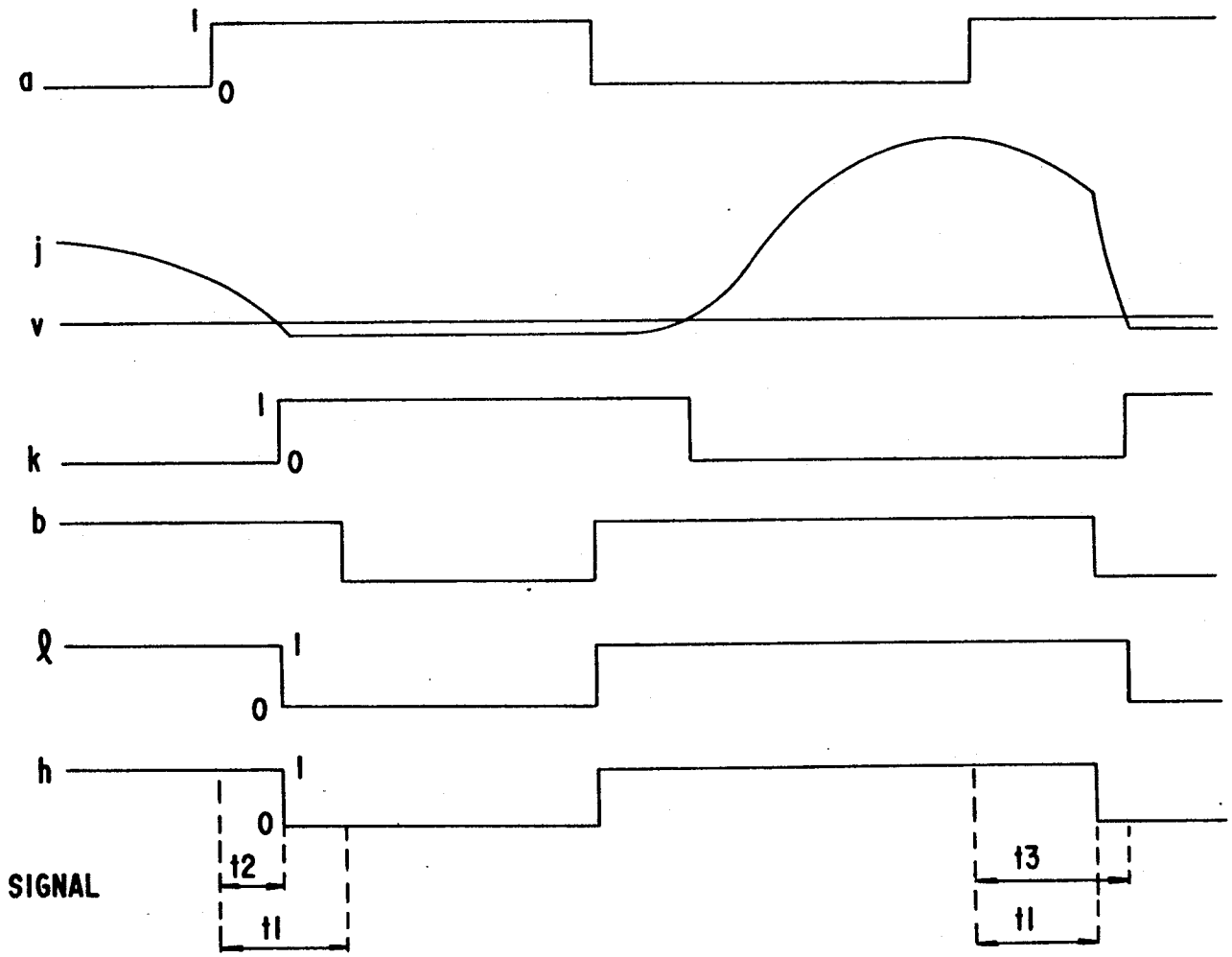
FIGS. 4 and 5 are timing diagrams for the embodiments as shown in FIGS. 2 and 3, respectively.

In the next place, the operation of this turning brake controlling system when the turning brake is actuated will be described with reference to the timing diagram as shown in FIG. 4.

When the turning lever signal a is changed from "0" to "1"; that is; when the turning lever, not shown, is shifted from its turning position to its neutral position, the voltage signal j from the F/V converter 5 will reduce in accordance with a reduction in the turning speed of the upper turning body. When the signal j becomes less than the reference voltage signal v from the reference voltage generator means 6 a time $t_2$ after the turning lever signal a has changed, the comparison signal k from the comparator 202 is changed from "0" to "1". The time $t_2$ at that time is preset irrespective of a delay time $t_1$ for the turning brake signal b from the turning brake signal transmitter 201.

When the comparison signal k becomes "1", both the signals a and k which are inputted to NAND circuit 203 become "1", so that the NAND signal l becomes "0", and hence the AND signal h from AND circuit 204 becomes "0" thereby rendering the turning brake actuator means 3 operative.

When the turning lever signal a is changed from "1" to "0", the turning brake signal b, the NAND signal l, and the AND signal h are changed from "0" to "1" at the same time, thereby releasing the turning brake.

Further, in case the turning speed of the upper turning body is high; that is to say; the voltage signal j from the F/V converter is high, and when the turning lever is shifted to its neutral; position, a time $t_3$ which passes until the voltage signal j becomes less than the reference voltage signal v will become longer than the delay time $t_1$ for the turning brake signal b, as shown on the right side in FIG. 4. In this case, the time which passes from the shifting of the turning lever to its neutral position until the turning brake is actuated will become longer than the above-mentioned delay time $t_1$.

Further, if the turning brake signal b from the turning brake signal transmitter 201 becomes "0" before the NAND signal l becomes "0", then the AND signal h becomes "0" thereby rendering the turning brake operative.

As mentioned hereinabove, when the turning lever is shifted from its turning position to its neutral position and the turning speed of the upper turning body becomes less than a preset value, the turning brake is actuated even if it occurs within the delay time for the turning brake.

Next, the third embodiment of the present invention will be described with reference to FIGS. 3 and 5. Further, in this third embodiment, the same components as those of the second embodiments as shown in FIG. 2 are indicated by the same reference numerals and reference symbols, the description of them is omitted to avoid the duplication of explanation.

Figure 3:
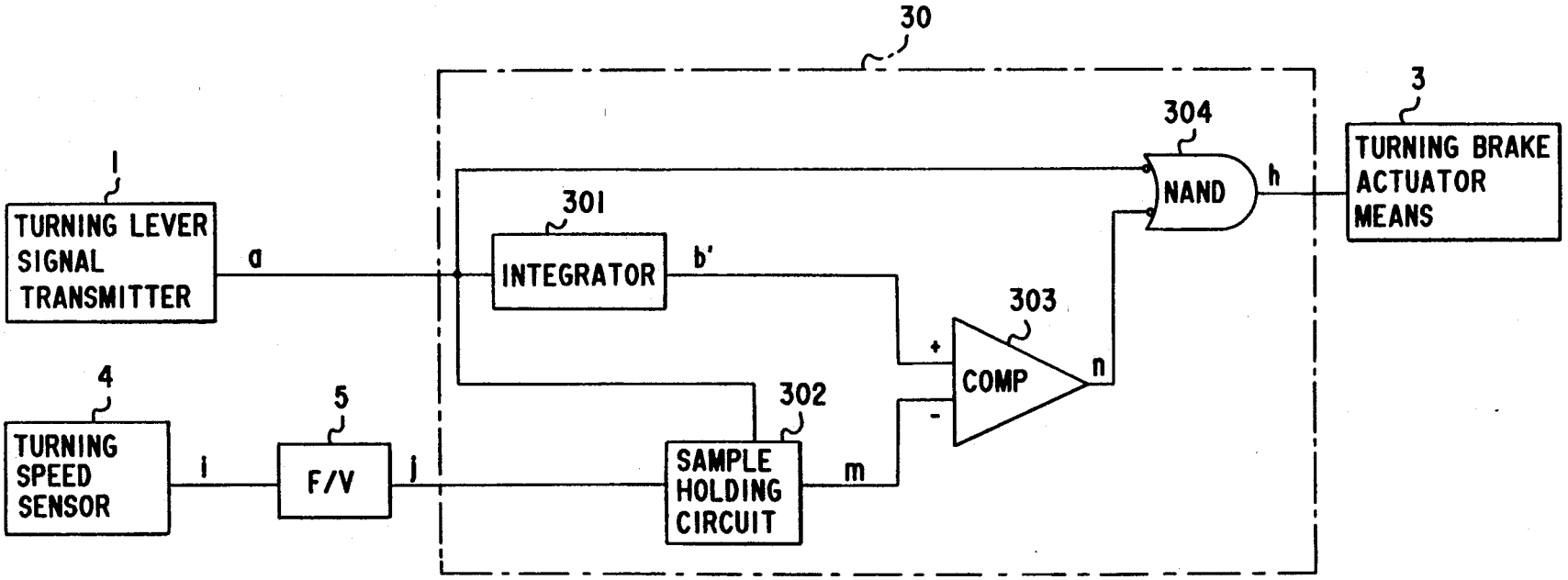
FIG. 3 is a block diagram schematically showing the principal parts of a third embodiment of the present invention.

In FIG. 3, reference numeral 30 denotes a turning brake controlling system which is similar to the system 20 as shown in FIG. 2. The turning brake controlling system 30 includes an integrator 301 adapted to integrate a turning lever signal a which is outputted by a turning lever signal transmitter 1; a sample holding circuit 302 adapted, when it receives the turning lever signal a; that is to say; the moment the turning lever is shifted from its turning position to its neutral position, to hold a voltage signal j which is outputted by a F/V converter 5 in accordance with the turning speed of the upper turning body at that time; a comparator 303 adapted to receive, as inputs thereof, a sample hold signal m which is outputted by the sample holding circuit 302 and a turning brake signal b' which is outputted by the integrator 301, compare these signals and output a comparison signal n; and a NAND circuit 304 adapted to receive, as inputs thereof, the turning lever signal a and the comparison signal n and output a turning brake actuating signal h to a turning brake actuator means 3 in accordance with the signals a and n.

In the above-mentioned configuration, since the turning lever signal a which is outputted when the upper turning body is turning is "0", NAND circuit 304 will output a turning brake release signal, which is "1" irrespective of the comparison signal n from the comparator 302, to the turning brake actuator means 3.

Figures 5A, 5B, 5C, 5D, 5E, 5F:
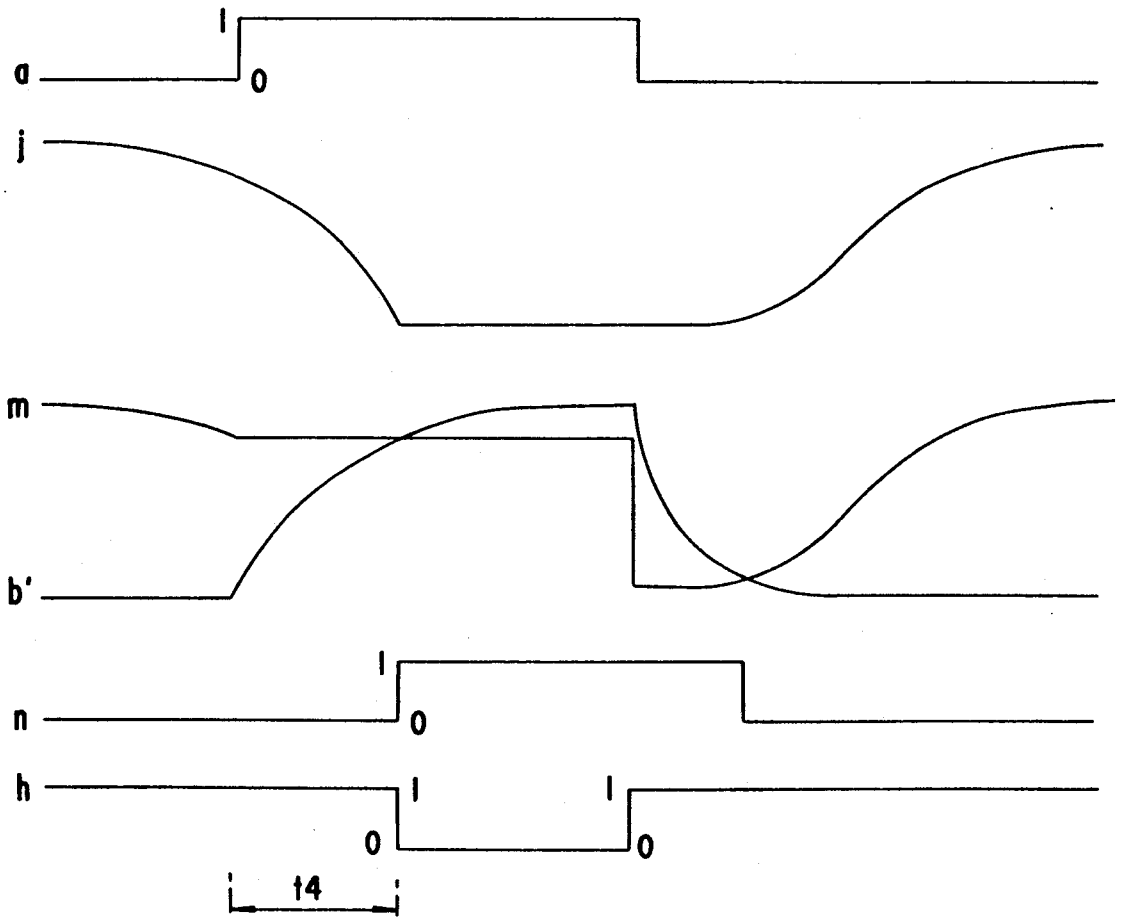

Next, the operation of the system when the turning brake is actuated will be described with reference to the timing diagram as shown in FIG. 5.

When the turning lever signal a is changed from "0" to "1"; that is to say; a turning lever, not shown, is shifted from its turning position to its neutral position, the output of the integrator 301; that is to say; an integration signal b' will gradually change with time from "0" to "1". At that time, the sample holding circuit 302 will hold an output of the F/V converter when the turning lever signal a is changed from "0" to "1"; that is; a voltage which is proportional to the turning speed of the upper turning body when the turning lever is shifted from its turning position to its neutral position, and output a sample hold signal m accordingly. The comparator 303 serves to compare always the integration signal b' with the sample hold signal m, and output a comparison signal n which is "1", when the output of the integration signal b' is increased and exceeds the voltage held by the sample holding circuit 302 a time $t_4$ after the turning lever signal a is changed from "0" to "1". Since the turning lever signal a is "1", the NAND signal h becomes "0" when the comparison signal n has become "1", and as a result, the turning lever actuator means 3 is rendered operative.

As mentioned hereinabove, the turning brake actuator means is actuated after a delay time which corresponds to the turning speed of the upper turning body when the turning lever is shifted from its turning position to its neutral position.

While the invention has been particularly shown and described in reference to preferred embodiments thereof, it will be understood by those skilled in the art that changes in form and details may be made therein without departing from the spirit and scope of the invention.

What is claimed is:

1. A turning brake controlling system for use in an upper turning body of a power shovel, comprising:

a microprocessor means for receiving a turning lever signal from a turning lever signal transmitter when a turning lever is shifted from a turning portion to a neutral position thereof, and for transmitting a turning brake actuating signal to the turning brake actuator means;

a microprocessor monitoring means operably connected to said microprocessor means for monitoring an operation of said microprocessor means;

a hardware circuit means connected in parallel with said microprocessor means for performing arithmetic functions of said microprocessor means; and a switching circuit means for switching output of said microprocessor means over to an output of said hardware circuit means in accordance with the actuation of said microprocessor monitoring means, wherein at least one of said microprocessor means and hardware circuit means includes a turning speed detector means for detecting a turning speed of said upper turning body when said turning lever is shifted from said turning position to said neutral position thereof and subsequent speeds thereof, and for outputting a turning speed signal corresponding to a detected turning speed; and a turning brake signal generator means for receiving said turning speed signal outputted by said turning speed detector means and said turning lever signal outputted by said turning lever signal transmitter means and for outputting a turning brake signal to said turning brake actuator means, and wherein said turning brake signal generator means is arranged to output a turning brake signal in a delay time which is present in accordance with the value of said turning speed signal.

2. A turning brake controlling system for use in a power shovel as claimed in claim 1, wherein said turning brake signal generator means outputs a turning brake signal when said turning speed signal becomes less than a preset value.

3. A turning brake controlling system for use in a power shovel as claimed in claim 2, wherein said turning speed detector means includes a turning speed sensor means for detecting said turning speed of said upper turning body of said power shovel and for outputting a turning speed signal corresponding to said detected turning speed, and a F/V converter means for receiving turning speed signal from said sensor means and for converting said turning speed signal into a voltage signal to be outputted therefrom, said turning brake signal generator means includes:

a turning brake signal transmitter means for receiving said running lever signal outputted by said lever signal transmitter and outputting a turning brake signal within a preset time after said turning lever is shifted from said turning position to said neutral position thereof, a reference voltage generator means for generating a reference voltage signal for defining a minimum turning speed of said upper turning body, a comparator for receiving said voltage signal from said F/V converter means and said reference voltage signal for comparing voltage between said reference and F/V converter signals, and for outputting a comparison signal, a NAND circuit means for receiving said comparison signal and said turning lever signal, and for outputting a NAND signal, and an AND circuit means for receiving said NAND signal and said turning brake signal from said turning brake signal transmitter means and for outputting an AND signal which corresponds to said NAND signals and turning brake signals to said turning brake actuator means.

4. A turning brake controlling system for use in a power shovel as claimed in claim 1, wherein said turning speed detector means includes:

a turning speed sensor means for detecting said turning speed of said upper turning body of said power shovel, and for outputting a turning speed signal corresponding to said detected turning speed, and a F/V converter for receiving said turning speed signal from said sensor means, and for converting said turning speed signal into a voltage signal, and wherein said turning brake signal generator means includes:

an integrator for integrating said turning lever signal outputted by said turning lever signal transmitter means, and for outputting an integration signal, a sample holding circuit means for receiving said turning lever signal the moment said turning lever is shifted from said turning position to said neutral position thereof, and for holding said voltage signal from said F/V converter means which is outputted in accordance with said turning speed of said upper turning body at that time, a comparator means for receiving sample hold signal outputted by said sample holding circuit means and said integration signal outputted by said integrator means, for comparing between said sample hold signal and integration signal, and for outputting a comparison signal, and a NAND circuit for receiving said turning lever signal and said comparison signal, and for outputting a NAND signal which corresponds to said turning lever signal and said comparison signal to said turning brake actuator means.

* * * * *